United States Patent [19]

Bremer

[11] 4,037,722

[45] July 26, 1977

[54] PROTECTIVE PACKAGING FOR BOTTLES

[76] Inventor: Donald Bremer, 6303 Mojave Drive, San Jose, Calif. 95120

[21] Appl. No.: 671,590

[22] Filed: Mar. 29, 1976

[51] Int. Cl.[2] ..... B65D 81/04; B65D 81/16

[52] U.S. Cl. ..... 206/523; 206/199; 206/203; 206/498; 217/25.5; 220/9 F; 229/2.5 R; 229/29 M

[58] Field of Search ..... 206/523, 199, 203, 427, 206/433, 498, 443, 446; 217/19, 21, 27, 35, 25.5, 26.5; 220/22, 9 F, 23.8; 229/29 M, 2.5 R

[56] References Cited

U.S. PATENT DOCUMENTS

| | | | |
|---|---|---|---|
| 662,190 | 11/1900 | Galbraith | 217/21 |
| 1,309,877 | 7/1919 | Browne | 217/21 |
| 2,042,446 | 5/1936 | Ferguson | 206/433 |
| 2,935,222 | 5/1960 | O'Connell | 217/19 |
| 3,294,270 | 12/1966 | Geisler | 206/433 |
| 3,750,871 | 8/1973 | Cook | 206/523 |
| 3,804,234 | 4/1974 | Gordon | 206/433 |

FOREIGN PATENT DOCUMENTS

| | | | |
|---|---|---|---|
| 935,463 | 4/1954 | France | 217/21 |
| 1,291,682 | 3/1962 | France | 206/433 |
| 656,487 | 5/1929 | France | 217/35 |
| 1,097,870 | 1/1968 | United Kingdom | 217/21 |
| 406,511 | 3/1934 | United Kingdom | 206/433 |

*Primary Examiner*—Stephen P. Garbe
*Assistant Examiner*—Bruce H. Bernstein
*Attorney, Agent, or Firm*—Howard A. Silber

[57] ABSTRACT

A protective packaging for bottles having different neck lengths includes a support block having circular recesses that receive the bottle bottoms, and a unitary, box-shaped bottle-neck-receiving retainer. The retainer has a flat bottom which serves as a web to support a plurality of inverted cups into which the bottle necks project. Each cup is frangible, and when the closed upper end is broken of, the remaining truncated conical cup wall receives a bottle neck that is too long to be accomodated completely within the unbroken cup, as can a shorter necked bottle. In this way both short and long necked bottles can be securely contained together in a single protective package.

5 Claims, 3 Drawing Figures

PROTECTIVE PACKAGING FOR BOTTLES

BACKGROUND OF THE INVENTION

1. Field of the Invention.

The present invention relates to protective packaging for bottles, and particularly to a design that facilitates secure packaging of bottles having different neck lengths.

2. Description of the Prior Art.

In retail establishments such as liquor stores, it is common for a customer to purchase several different spirits, each in a bottle of different size, shape or neck length. Secure packaging of such a selection is difficult. Typically the merchant will use a corrugated cardboard box having dividers consisting of flat pieces of cardboard slit and interleaved to form a matrix of chambers each receiving a single bottle. Probably the box will be secondhand, having previously been used by the distiller to ship say a dozen bottles of the same drink.

Such reused packaging is satisfactory only if bottles of the same size are sold. When an assortment of differently sized or shaped bottles are packed, the cardboard dividers must be folded over, or extra cardboard stuffed in to prevent movement of the bottle. Moreover, long necked bottles may prevent the box top from closing completely. Secure packing cannot be achieved. Delivery services will not accept such packages, or if they do accept them, will not guarantee safe delivery of the bottles in unbroken condition. Insurance carriers will not insure merchandise so packed. Accordingly, it is an object of the present invention to provide a secure packaging for bottles, and particularly for bottles of different size or neck length. A further object is to provide such a packaging that is inexpensive, lightweight, and which facilitates stacking. Another object is to provide a bottle packing, useful with bottles of different sizes, which will prevent lateral movement of the bottles, and hence prevent breakage in shipment.

SUMMARY OF THE INVENTION

These and other objectives are achieved by providing a protective packaging for bottles that is advantageously formed of expanded or blown plastic. The package includes a generally rectangular bottle support block which has a plurality of spaced recesses that receive the bottoms of individual bottles. The bottle necks and tops are received in a separate, unitary, box-shaped retainer which has a plurality of bottle-neck-receiving inverted cups formed as integral components of the retainer bottom.

The bottle-neck-receiving cups are positioned in the same arrangement as the recesses in the support block. Thus when bottles are placed in the recesses, the retainer member can be easily placed over the bottle tops, so that the necks project into the inverted cups. Each cup is frangible. Thus if the neck of a particular bottle is longer than the inverted cup, the closed top of the cup easily can be broken off. The long bottle neck then can project through the remaining truncated cup section. The tops of other, shorter bottles will project into the unbroken cups. In this way, each bottle is securely protected. The cups and retainer bottom section prevent lateral movement of the bottles, thereby preventing breakage in shipment. This is true even if there are fewer bottles present than the maximum capacity of the package. The arrangement also prevents vertical movement of the bottles, particularly when used in conjunction with a cover that fits into a box-like retainer, and optionally, an inexpensive, thin cardboard outer container.

BRIEF DESCRIPTION OF THE DRAWINGS

A detailed description of the invention will be made with reference to the accompanying drawings wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
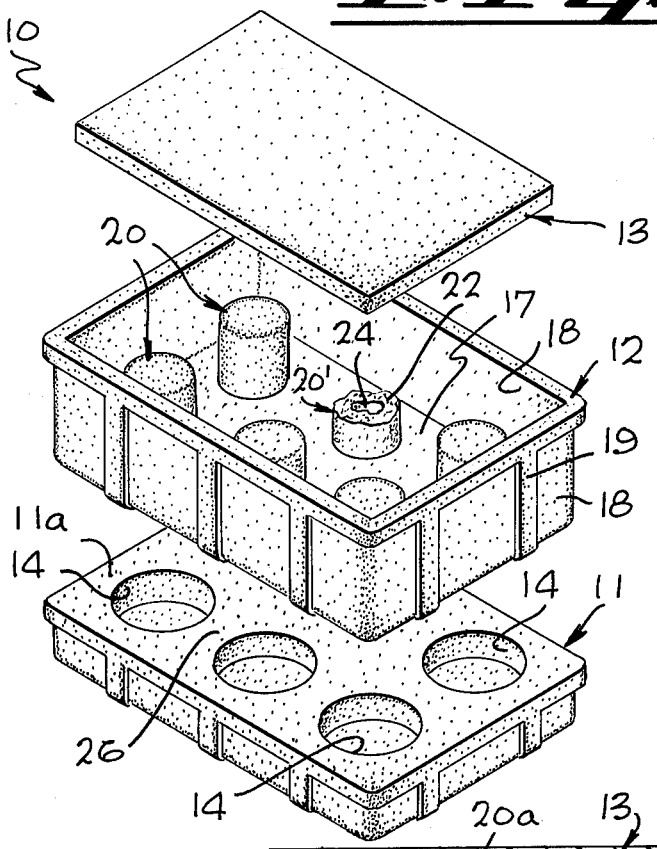
FIG. 1 is a perspective view of the inventive protective packaging for bottles.
Figure 2:
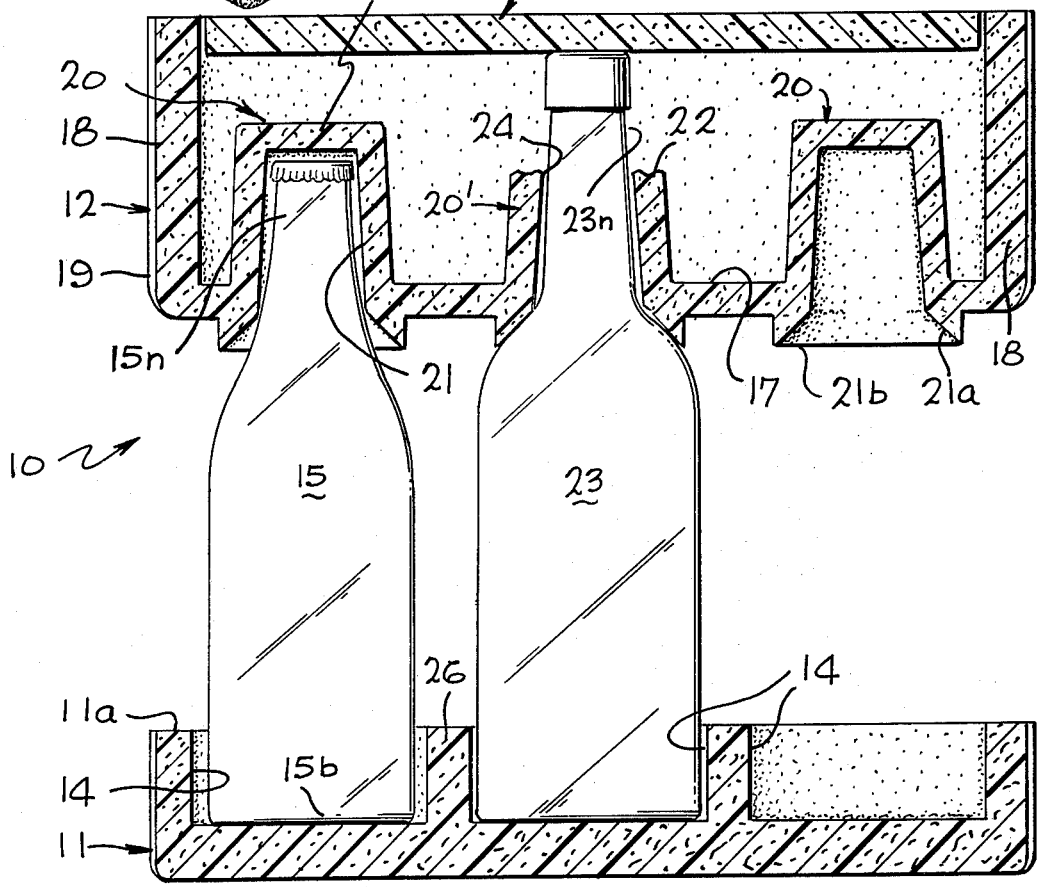
FIG. 2 is a transverse sectional view of the packaging of FIG. 1 showing the manner in which bottles having different neck lengths are accommodated.

Referring to FIGS. 1 and 2, the inventive protective packaging 10 includes a bottle support block 11, a unitary bottle neck retainer 12, and an optional cover 13. Advantageously, each is formed of expanded or blown plastic, so as to be lightweight, inexpensive, and easy to fabricate.

The support block 11 has a generally rectangular solid shape, and has a typical height of about two inches. Arranged on the top 11*a* of the support block 11 are a plurality of recesses 14 each of which receives the base or bottom of a bottle such as the bottom 15*b* of the bottle 15. Typically each recess 14 may be circular and have a diameter of about 3 $\frac{1}{8}$ inches and a depth of about 1 $\frac{1}{4}$ inch.

The unitary bottle neck retainer 12 is generally box-shaped and has a rectangular, flat bottom 17 and four upright sides 18 that have a typical height of about 4 $\frac{1}{4}$ inches. Ribs 19 may be formed as an integral part of the wall 18 to provide strength and to reduce the amount of material required for the retainer 12.

The retainer bottom 17 typically is about $\frac{3}{4}$ inch thick, and serves as a web to retain a plurality of inverted cups 20 that receive the bottle necks such as the neck 15*n* of the bottle 15. The cups 20 are of the same number and geometrical arrangement as the bottle-base-receiving recesses 14 in the support block 11. Thus after the bottles 15 have been placed in the recesses 14, the retainer 12 can be placed over the bottles 15 so that each neck 15*n* is received within the interior 21 of a respective inverted cup 20. To guide the insertion, the bottom 21*a* of the cup interior 21 is outwardly flared, and the circular lip 21*b* at the bottom of each cup 20 projects below the bottom surface of the web section 17.

Each of the inverted cups 20 is frangible. That is, the closed, upper end 20*a* and the adjacent side portions of the cup 20 easily can be broken off, leaving a truncated, slightly conical cup wall 22. This permits the long neck 23*n* of a bottle 23 to project up through the open end 24 of the cup 20′ which has been broken off. In this manner, as illustrated in FIG. 2, the inventive bottle packaging 10 can accomodate bottles 15, 23 of different neck length. The flat, planar cover 13 may be inserted within the side walls 18 and rest on top of the bottle 23, or on top of the cups 20 if none has been broken.

Figure 3:
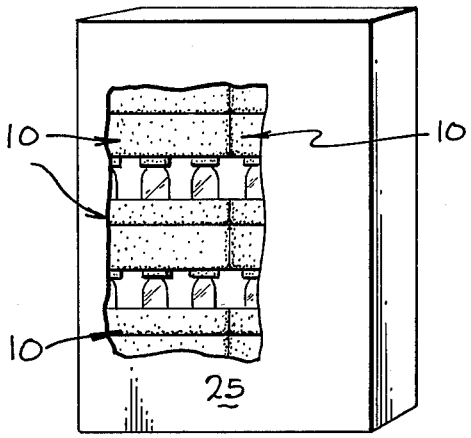
FIG. 3 is a side view of an exterior container that may be used with the inventive packaging; the view is partly broken away to show how the inventive packages may be stacked.

Advantageously, the inventive bottle packaging 10 with the bottles 15, 23 may be placed within an inexpensive, thin cardboard outer box. Such a box may cover only a single package 10. Alternatively, a single such box 25 may contained a plurality of stacked bottle packages 10 as shown in FIG. 3. Indeed, the thickness of the sidewalls 18 (typically $\frac{5}{8}$ inch) is sufficient to support the bottle-base-receiving block 11 of another package 10, even if the cover 13 is not used.

Since each bottle 15, 23 is accomodated in an individual recess 14 and cup 20, lateral bottle movement is restricted by the material 26 between adjacent recesses 14, so that the bottles cannot strike one another in transit. Breakage is prevented. This is so even when there are fewer bottles contained in the package 10 than its capacity. Such security also is provided even if the shoulder of one or more of the bottles is narrow and does not rest against the flared bottom edge 21*a* of the cup 20. In the instance of such a narrow shoulder and necked bottle, vertical movement is prevented either by the closed end 20*a* of the cup 20 (as in the case of the bottle 15 in FIG. 2), or by the edge 21*a,* or by the cover 13.

Although the invention is not so limited, the use of expanded or blown plastic to form the package 10 is particularly advantageous. This material has inherent mechanical strength, particularly when molded in the shape illustrated, and has a certain inherent impact resistance. Moreover, cups 20 formed of this expanded plastic material are readily frangible. The material is sufficiently inexpensive so that the packaging can be used by a retailer at low cost.

Intending to claim all novel, useful and unobvious features shown or described, the inventor makes the following claims:

1. A protective packaging for bottles having different neck lengths, comprising:

a bottle support block having a plurality of bottle-base-receiving recesses therein, and a generally box-shaped unitary bottle neck retainer having;

a. a generally planar web section forming the bottom of said retainer, the length and width of said retainer corresponding to the like dimensions of said support block, b. sidewalls projecting upwardly from the periphery of said web section, and c. a like plurality of bottle-neck-receiving inverted cups integrally attached to said web section in geometric conformity with the arrangement of said recesses in said support block, said neck-receiving cups also projecting upwardly from said web section, the height of said sidewalls being greater than the height above said web section of said cups, said retainer being adapted to slip over the necks of bottles supported in said block, the upper portion of each cup extending above said web section and being individually flangible so as to accommodate a bottle having a neck of length greater than that received completely within one of said unbroken cups, said neck of greater length projecting through the opening in said cup exposed by breaking off the upper portion thereof.

2. A protective packaging according to claim 1 wherein said support block and said bottle neck retainer both are of expanded plastic, said cups being formed integrally with said web section.

3. A protective packaging according to claim 1 further comprising a generally planar lid for said retainer, said lid being dimensioned to seat within said sidewalls above said bottle neck receiving cups, said sidewalls being of sufficient height so as to extend enough above said neck of greater length so that said lid can seat within said sidewalls atop said greater length bottle neck, said support block, said retainer and said lid all being formed of expanded plastic.

4. A protective packaging according to claim 1 wherein the open end of each neck-receiving cup projects below said web section and includes an outwardly flared edge.

5. At least one protective packaging according to claim 1 contained in a thin cardboard outer box.

* * * * *